US008096059B2

(12) United States Patent
Stagg

(10) Patent No.: US 8,096,059 B2
(45) Date of Patent: Jan. 17, 2012

(54) DYNAMIC BOW ALIGNMENT, ANALYSIS AND REPAIR APPARATUS AND SYSTEM

(76) Inventor: Wesley Stagg, Chillicothe, MO (US)

( * ) Notice: Subject to any disclaimer, the term of this patent is extended or adjusted under 35 U.S.C. 154(b) by 561 days.

(21) Appl. No.: 12/233,379

(22) Filed: Sep. 18, 2008

(65) Prior Publication Data

US 2009/0071022 A1 Mar. 19, 2009

Related U.S. Application Data

(60) Provisional application No. 60/973,271, filed on Sep. 18, 2007.

(51) Int. Cl.
*G01B 1/00* (2006.01)

(52) U.S. Cl. ..... 33/506; 124/1

(58) Field of Classification Search ..... 33/506, 33/265, 1 BB; 124/86–87, 1; 248/176.3; 482/120; 356/3.1; 42/115
See application file for complete search history.

(56) References Cited

U.S. PATENT DOCUMENTS

| | | | | | |
|---|---|---|---|---|---|
| 2,895,729 | A | * | 7/1959 | Sanders | 269/17 |
| 3,641,675 | A | * | 2/1972 | Funk, Jr. | 33/265 |
| RE32,123 | E | * | 4/1986 | Knight | 235/400 |
| 4,708,341 | A | * | 11/1987 | Paraskevakos | 482/120 |
| 4,753,528 | A | * | 6/1988 | Hines et al. | 356/3.04 |
| 4,993,397 | A | * | 2/1991 | Cryar et al. | 124/23.1 |
| 5,121,736 | A | * | 6/1992 | Hawk | 124/86 |
| 5,152,068 | A | * | 10/1992 | Meister et al. | 33/265 |
| 5,175,937 | A | * | 1/1993 | Emerson, III | 33/503 |
| 5,201,304 | A | * | 4/1993 | Rezmer | 124/24.1 |
| 5,419,050 | A | * | 5/1995 | Moore | 42/115 |
| 5,495,675 | A | * | 3/1996 | Huang | 42/115 |
| 5,628,300 | A | * | 5/1997 | Wallendorff | 124/1 |
| 5,954,041 | A | * | 9/1999 | Sands | 124/1 |
| 5,983,879 | A | * | 11/1999 | Gifford | 124/1 |
| 6,029,643 | A | * | 2/2000 | Golfieri | 124/1 |
| 6,220,235 | B1 | * | 4/2001 | Sands | 124/1 |
| 6,366,344 | B1 | * | 4/2002 | Lach | 356/3.1 |
| 6,386,190 | B1 | * | 5/2002 | Kurtz, Jr. | 124/1 |
| 6,526,666 | B1 | * | 3/2003 | Lastinger, Jr. | 33/265 |
| 6,637,122 | B2 | * | 10/2003 | Henry | 33/506 |
| 6,862,813 | B1 | * | 3/2005 | Chen et al. | 33/265 |
| 6,932,070 | B1 | * | 8/2005 | Kurtz, Jr. | 124/1 |
| 7,216,643 | B2 | * | 5/2007 | Pellerite | 124/86 |
| 7,231,721 | B2 | * | 6/2007 | Minica et al. | 33/265 |
| 7,353,611 | B2 | * | 4/2008 | Edwards et al. | 33/265 |
| 2002/0014017 | A1 | * | 2/2002 | Egan | 33/512 |
| 2004/0014010 | A1 | * | 1/2004 | Swensen et al. | 434/21 |
| 2010/0258628 | A1 | * | 10/2010 | Bay | 235/404 |

* cited by examiner

*Primary Examiner* — Brad Bennett
*Assistant Examiner* — Tania Courson
(74) *Attorney, Agent, or Firm* — Patwrite LLC; Mark David Torche

(57) ABSTRACT

A dynamic bow alignment, analysis and repair apparatus and system comprises an adjustable frame allowing the frame to adjust to fit any size bow. An air ram is used to controllably draw the shooting string as needed. A reference laser alignment module is mounted to a bow riser and allows a user to consistently and reliably align any bow for optimum performance based on the particularities of the selected bow subject to wear, defects and design constraints. The system removes the guesswork and allows a user to optimize any bow. A laser equipped arrow works in conjunction with the alignment module to allow the user to correctly position the shooting rest and nock indexer, and expose all functional anomalies. The system allows a user to completely quantify the performance parameters of bow performance including speed and spine tests. The system serves all major alignments and repairs.

3 Claims, 20 Drawing Sheets

DYNAMIC BOW ALIGNMENT, ANALYSIS AND REPAIR APPARATUS AND SYSTEM

RELATED APPLICATIONS

This application claims priority and herein incorporates by reference U.S. provisional patent application 60/973,271, filed Sep. 18, 2007.

BACKGROUND OF THE INVENTION

Since humans lack claws, beaks, fangs or great strength, we have had to develop weapons for survival. In the beginning, rocks and sticks served to provide a lethal edge, but humans soon began to refine these weapons by forming spears from the sticks and placing the rocks in a sling. Most experts agree that the invention of the bow and arrow was one of the most significant inventions of the human race and enabled humans to survive and dominate their environment. Archeological evidence shows the bow and arrow came into use in the early Neolithic era between 7,000 to 9,000 years ago, and possibly earlier in some regions, and was the weapon of choice for hunting until the advent of firearms. Today, the tradition continues by sportsman all over the world.

From the earliest times, accuracy was always an issue and the best archers developed secrets to tune their bows, but it was based on trial by error and great experience. Of course early bows had very little to adjust compared to modern compound bows. The modern bow has many possible adjustments and each adjustment has an effect on all the other adjustments which makes tuning the bow by traditional means a very difficult and empirical pursuit.

There is a need for an apparatus and method that allows a user to dynamically align or tune a bow without guesswork required by current methods. Additionally, there is a need for an apparatus and method that provides consistent results regardless of who does the alignment. There is also a need for an apparatus and method that optimizes the performance of any given bow.

SUMMARY OF THE INVENTION

A dynamic bow alignment, analysis and repair apparatus and system comprises an adjustable frame allowing the frame to adjust to fit any size bow. An air ram is used to controllably draw the shooting string as needed. A reference laser alignment module is mounted to a bow riser and allows a user to consistently and reliably align any bow for optimum performance based on the particularities of the selected bow subject to wear, defects and design constraints. The system removes the guesswork and allows a user to optimize any bow. A laser equipped arrow works in conjunction with the alignment module to allow the user to correctly position the shooting rest and nock indexer, and expose all functional anomalies. The system allows a user to completely quantify the performance parameters of bow performance including speed and spine tests. The system serves all major alignments and repairs.

Other features and advantages of the instant invention will become apparent from the following description of the invention which refers to the accompanying drawings.

DETAILED DESCRIPTION OF THE INVENTION

Figure 1:
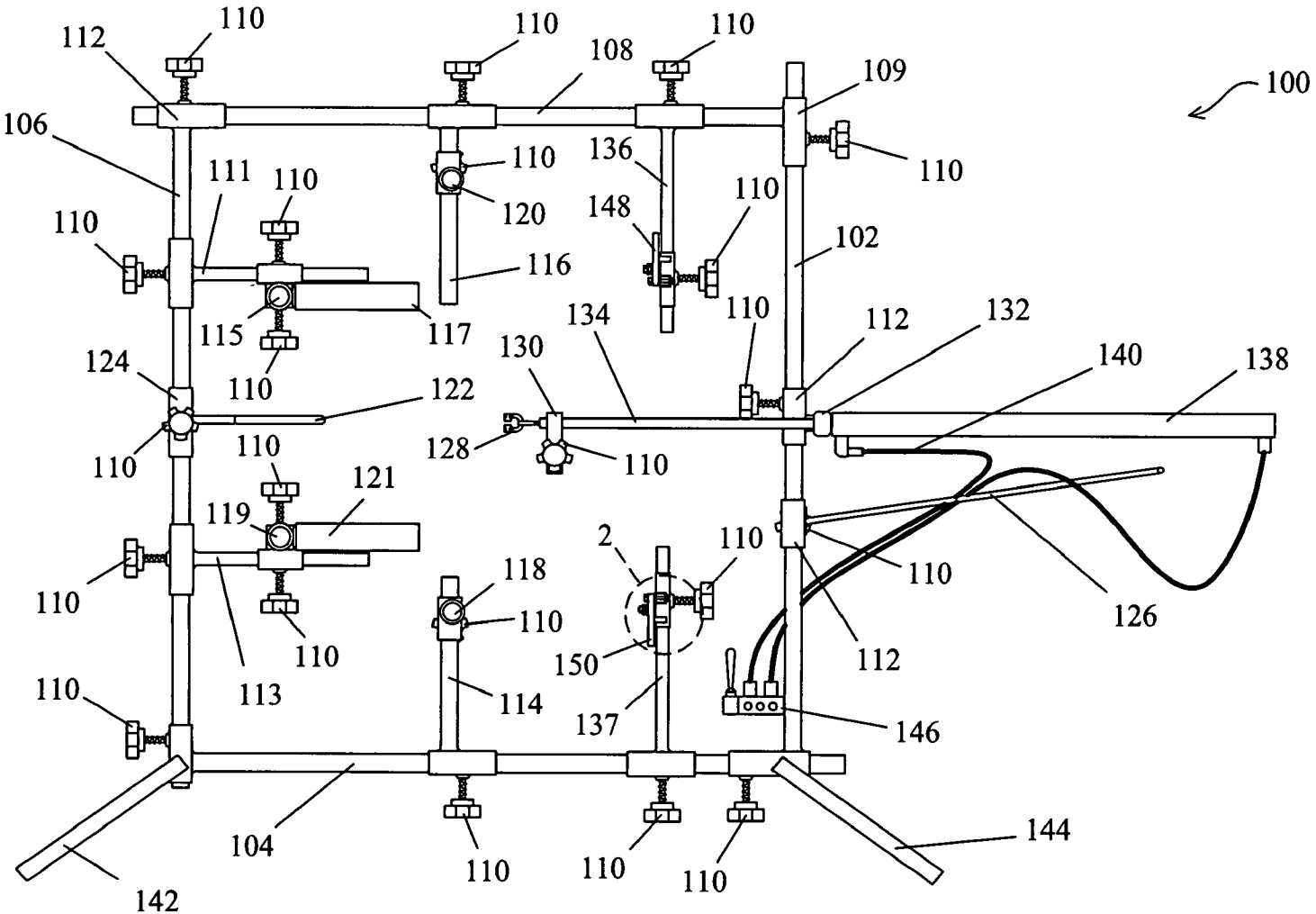
FIG. 1 is a side view of a bow alignment, analysis and repair apparatus according to an embodiment of the present invention.
Figure 2:
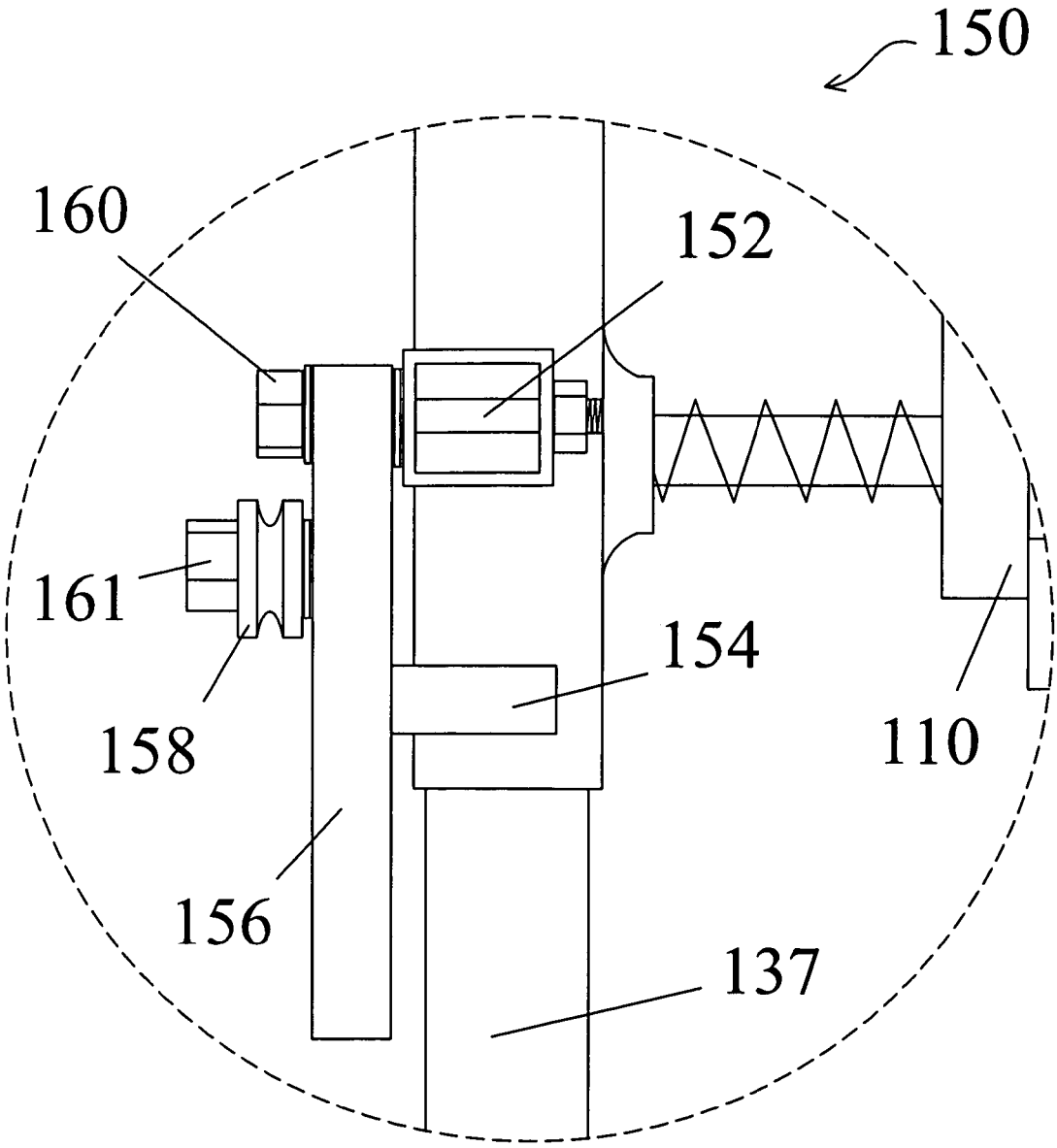
FIG. 2 is a detailed view of a section shown in FIG. 1.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIG. 1, a bow alignment, analysis and repair frame 100 is shown having a first vertical frame support 106 and a second vertical frame support 102. An upper horizontal frame support 108 and lower horizontal frame support 104 are provided to complete frame 100. A first leg portion 142 includes a clamping knob 110 to provide adjustability by allowing first vertical frame support 106 to selectively move up or down as needed to match a particular bow being aligned (not shown). A second leg portion 144 is allowed to move along lower horizontal frame support 104 with adjustment knob 110 for securing the selected position to adjust as discussed above. The use of clamping knobs 110 for adjustability include a threaded portion that provides an adjustable friction grip as the knob is rotated. The threaded portion is forced against a frame portion as is known in the art. Although all like knobs are labeled 110, it is understood that other types of locking mechanisms may be used without departing from the disclosure such as elliptical levers or others as is known in the art.

A ram control 146 is mounted on second vertical frame support 102 to control an air ram 138. Of course ram control 146 may be mounted in other areas such as on second leg portion 144 or even equipped with a remote activator as is known in the art. An adjusting slide 112 is attached to the top of first vertical frame support 106 and slides over an end of horizontal frame support 108 also using clamping knob 110 to selectively secure horizontal frame support 108 therein. A similar adjusting slide 109 is attached to the other end of horizontal frame support 108 and clamping knob 110 is provided for adjustability. Second leg portion 144 is attached to a bottom portion of second vertical frame support 102 and includes a sliding portion with clamping knob 110 that adjustably slides over lower horizontal frame support 104.

Figure 3:
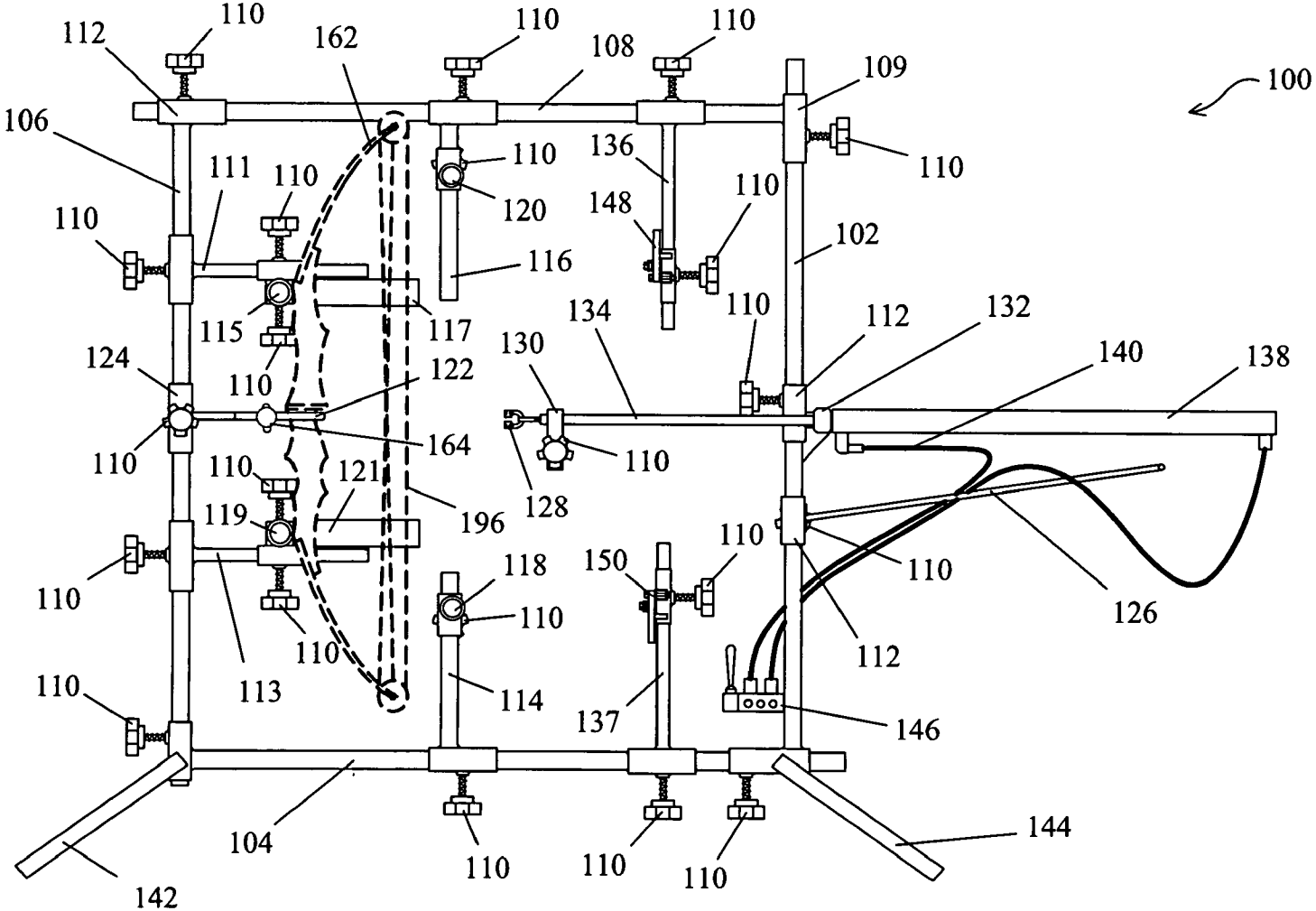
FIG. 3 is a side view of the bow alignment, analysis and repair apparatus shown in FIG. 1 with a bow mounted therein.

Referring now to FIGS. 1 and 3, an upper riser brace support 111 and a lower riser brace support 113 are moveably disposed on first vertical frame support 106 using sliders with clamping knobs 110. Upper riser brace support 111 has an upper riser stop brace 115 which is horizontal and perpendicular to the horizontal frame supports 108 and 104 and an upper riser side brace 117 which is also horizontal but parallel to the horizontal frame supports 108 and 104. Upper riser side brace 117 is in close proximity and is used to stabilize bow 162 but does not normally come in contact with bow 162. Similarly lower riser brace support 113 moveably supports a lower riser stop brace 119 and a lower riser side brace 121.

In use, both upper and lower riser brace supports 111 and 113 are positioned to support the riser portions of bow 162. The purpose of the riser side braces 117 and 121 is to prevent bow 162 from rolling around bow yoke 122. When engaging the riser stop braces 115 and 119, bow 162 is butted up against upper riser stop brace 115 and lower riser stop brace 119. This position is useful for various adjustments but both upper riser stop brace 115 and lower riser stop brace 119 must be disengaged to perform some procedures.

Upper riser brace stop 115 and lower riser brace 119 are engaged and disengaged by adjusting clamping knobs 110 and sliding along upper riser brace support 111 and lower riser support brace 113 respectively. As upper riser stop 115 and lower riser stop 119 are moved, both upper riser side brace 117 and lower riser side brace 121 maintain their same relative position with respect to bow 162 to continue to provide roll stability regardless of the position of the stops 115 and 119.

To adjust bow alignment, analysis and repair frame 100, first leg portion 142 is adjusted by loosening clamping knob 110 attached therein and positioning first vertical frame support 106 to the desired position and tightening clamping knob 110. Next upper horizontal frame support 108 is positioned by loosening the clamping knob 110 disposed on slider 112, positioning and then tightening clamping knob 110. To maintain orthogonality, slider 109 connected to upper horizontal frame support 108 is also positioned along second vertical frame support 102 in conjunction with the slider attached to first leg portion 142. Likewise, the slider connected to second leg portion 144 is adjusted in coordination with slider 112 connected to first vertical frame support 106. In this manner, a full range of bow sizes are accommodated.

An upper limb brace support 116 is slidably adjustable along upper horizontal frame support 108 and positioned using a clamping knob 110. An upper limb brace 120 is slidably adjustable along upper limb brace support 116 using another clamping knob 110. A lower limb brace support 114 is slidably adjustable along lower horizontal frame rod 104 and is positioned using another clamping knob 110. A lower limb brace 118 is slidably adjustable along lower limb brace support 114 using another clamping knob 110. An adjusting slide 124 is vertically adjustable along first vertical frame support 106 using a clamping knob 110 and allows a bow yoke 122 to be properly positioned for use.

An upper limb fixture 136 is slidably adjustable along upper horizontal frame support 108 using another clamping knob 110. An upper limb measurement fixture 148 adjustably slides up and down and is secured in a selected position using yet another clamping knob 110. Likewise, a lower limb fixture 137 is slidably adjustable along lower horizontal frame support 104 using another clamping knob 110. A lower limb measurement fixture 150 adjustably slides up and down and is secured in a selected position using another clamping knob 110.

It is possible to combine the functionality of upper limb brace support 116 and upper limb fixture 136 since generally only one of these components would be engaged at any one time. Likewise, both lower limb brace support 114 and lower limb fixture 137 may be combined. In an embodiment using a combined configuration, a double-sided attachment is used having a limb brace on one side and a limb fixture on the other. A user merely selects the appropriate end (limb brace or limb fixture) and then places the selected side on a single moveable attachment that is positioned for use.

Air ram 138 is slidably adjustable along second vertical frame support 102 using an adjusting slide 112 and a clamping knob 110. A ram mounting ring 132 is provided to support air ram 138. An air ram shaft 134 controllably moves back and forth in response to input from air ram control 146 to provide the required pull and release for bow 162. Air ram shaft 134 engages a horseshoe indexer 128 to allow air ram 138 to draw and controllably release string 196. A ram support 126 is adjustably disposed on vertical frame rod 102 using another adjusting slide 112 and a clamping knob 110 and provides support for air ram 138 in use. Air ram tubing 140 connects air ram 138 with air ram control 146 and with an air source (not shown).

Referring now to FIGS. 1 through 8, lower limb measurement fixture 150 is pivotally disposed using pivot 152 and held in place by a bolt and nut 160. A lower limb fixture swing arm 156 rotates around pivot 152 and is used to position a limb scale 200. A limb scale holder 158 is held in place using a bolt 161. A swing arm stop 154 is used to limit the movement of lower limb fixture swing arm 156. Of course other attachment methods would be acceptable such as rivets or pin and retainer and could be used in place of bolt as is known in the art.

Figure 23:
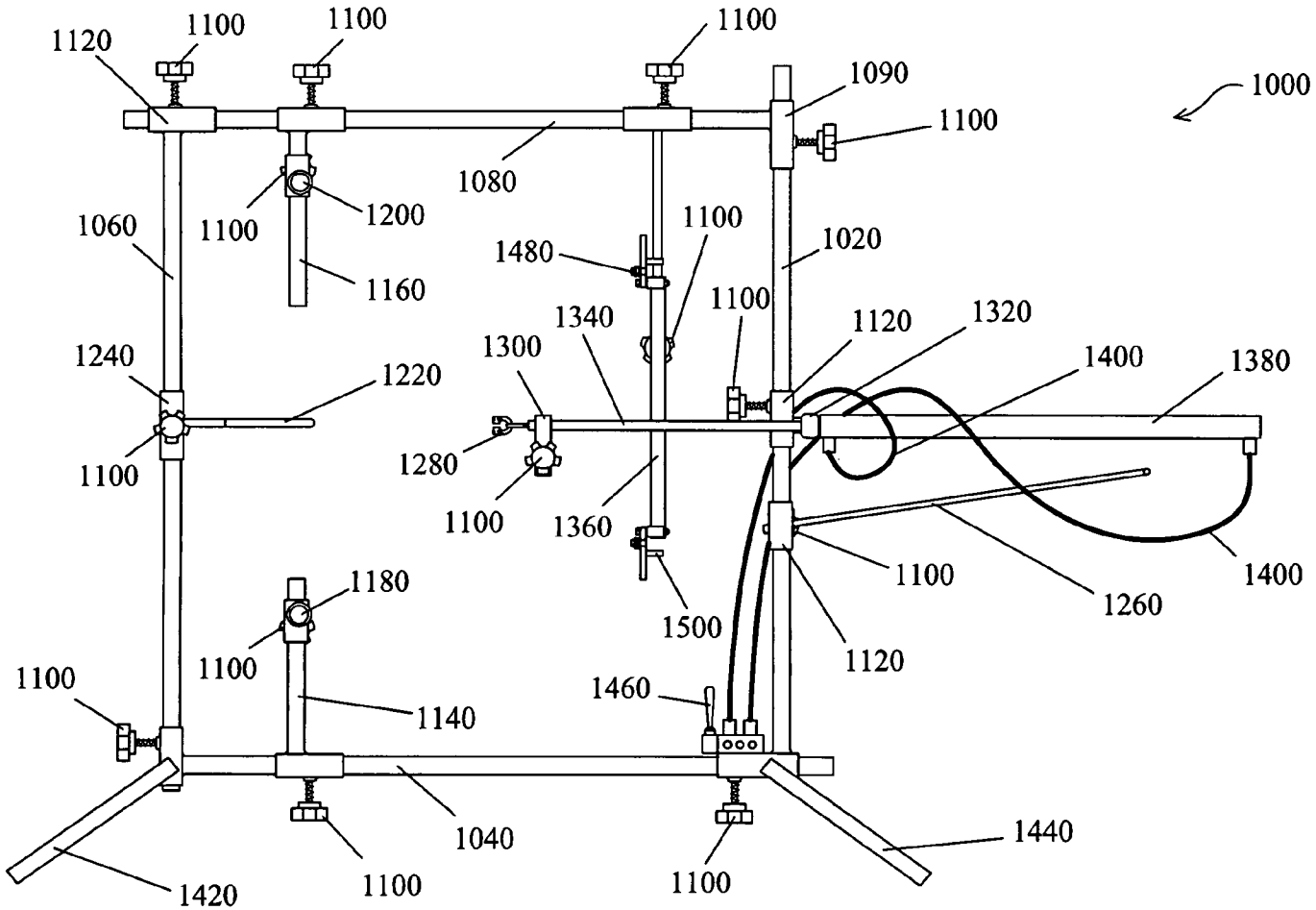
FIG. 23 is a side view of a bow alignment, analysis and repair apparatus according to another embodiment of the present invention.

Also, as shown in FIG. 23, an alternative embodiment of a bow alignment, analysis and repair apparatus frame 1000 is shown having a single limb fixture 1360. Similar to the above description, frame 1000 is shown having a first vertical frame support 1060 and a second vertical frame support 1060. An upper horizontal frame support 1080 and lower horizontal frame support 1040 are provided to complete frame 1000. A first leg portion 1420 includes a clamping knob 110 to provide adjustability by allowing first vertical frame support 1060 to selectively move up or down as needed to match a particular bow being aligned (not shown). A second leg portion 1440 includes a ram control 1460 and another adjustment knob 1100 for adjustability. An adjusting slide 1120 is attached to the top of first vertical frame support 1060 and slides over an end of upper horizontal frame support 1080 and a clamping knob 1100 provides adjustability. A similar adjusting slide 1090 is attached to the other end of upper horizontal frame support 1080 and clamping knob 110 is provided for adjustability. Second leg portion 1440 is attached to the bottom of second vertical frame support 1020 and includes a sliding section that adjustably slides over lower horizontal frame support 1040

An upper bow brace support 1160 is slidably adjustable along upper horizontal frame support 1080 and positioned using a clamping knob 1100. An upper limb brace 1200 is slidably adjustable along upper bow brace support 1160 using clamping knob 1100. A lower bow brace support 1140 is slidably adjustable along lower horizontal frame support 1040 and is positioned using a clamping knob 1100. A lower limb brace 1180 is slidably adjustable along lower bow brace support 114 using another clamping knob 1100. An adjusting slide 1240 is vertically adjustable along first vertical frame support 1060 using a clamping knob 1100 and allows a bow yoke 1220 to be properly positioned for use.

A limb fixture 1360 is slidably adjustable along upper horizontal frame support 1080 using a clamping knob 1100. Limb fixture 1360 adjustably slides up and down and is secured in a selected position using a clamping knob 1100. An upper limb measurement fixture 1480 and lower limb measurement fixture 1500 are provided to facilitate an aligning measurement.

An air ram 1380 is slidably adjustable along second vertical frame support 1020 using adjusting slide 1120 and a clamping knob 1100. A ram mounting ring 1320 is provided to support air ram 1380. An air ram shaft 1340 controllably moves back and forth in response to input from an air ram control 1460 to provide the required pull and release for a bow (not shown). Air ram shaft 134 engages a horseshoe indexer 128 to allow air ram 138 to draw and controllably release a bow string. A ram support 1260 is adjustably disposed on second vertical frame support 1020 using adjusting slide 1120 and a clamping knob 1100 and provides support for air ram 1380 in use. Air ram tubing 1400 connects air ram 1380 with air ram control 1460 and with an air source (not shown).

FIG. 3 illustrates bow alignment, analysis and repair frame 100 with a bow 162 installed. Bow 162 is held in place by bow yoke 122 and a bow restraint strap 164. Bow 162 is shown with a bow string 196.

Figure 4:
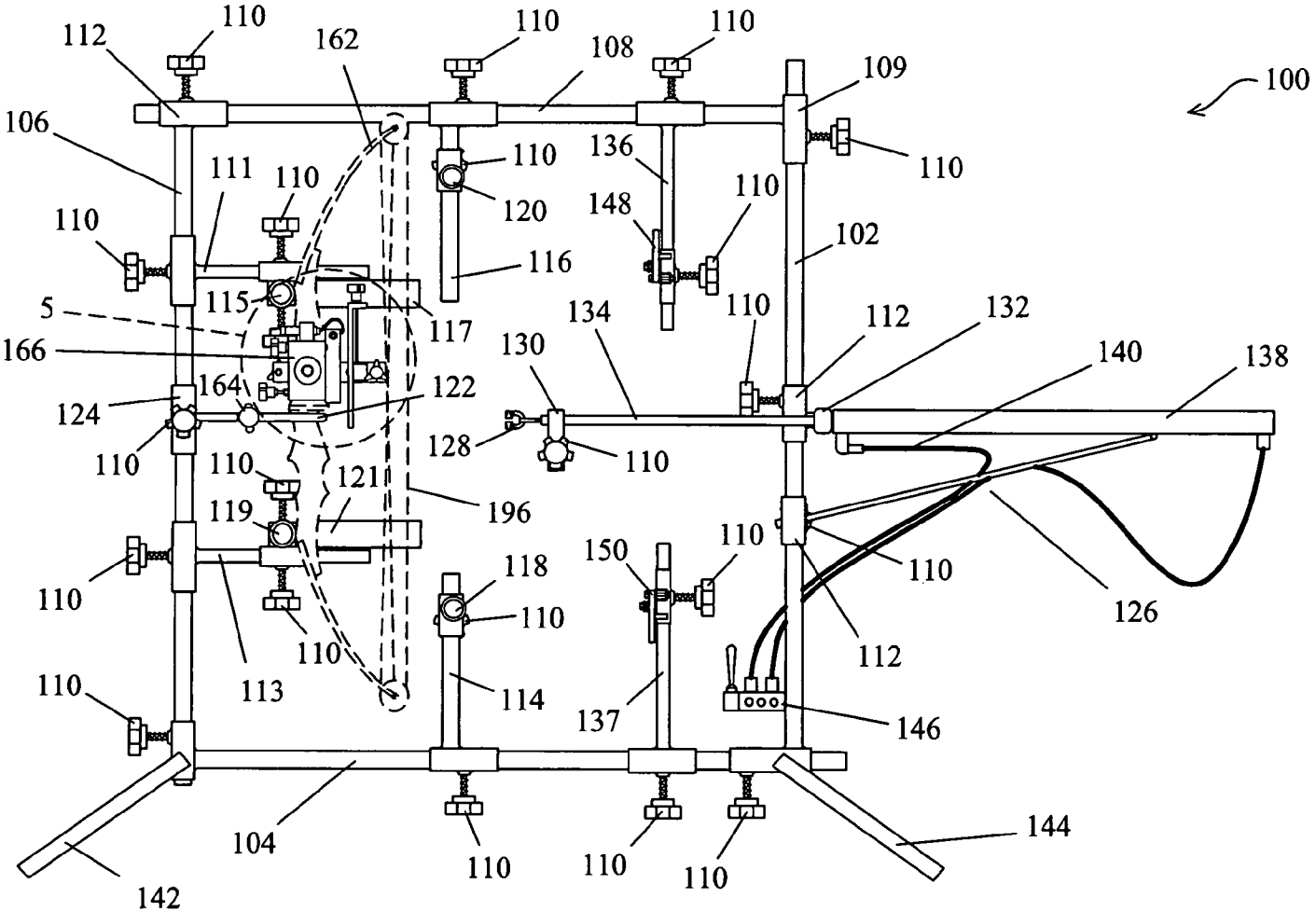
FIG. 4 is a side view of the bow alignment, analysis and repair apparatus shown in FIG. 1 with a reference laser alignment module mounted therein.
Figure 5:
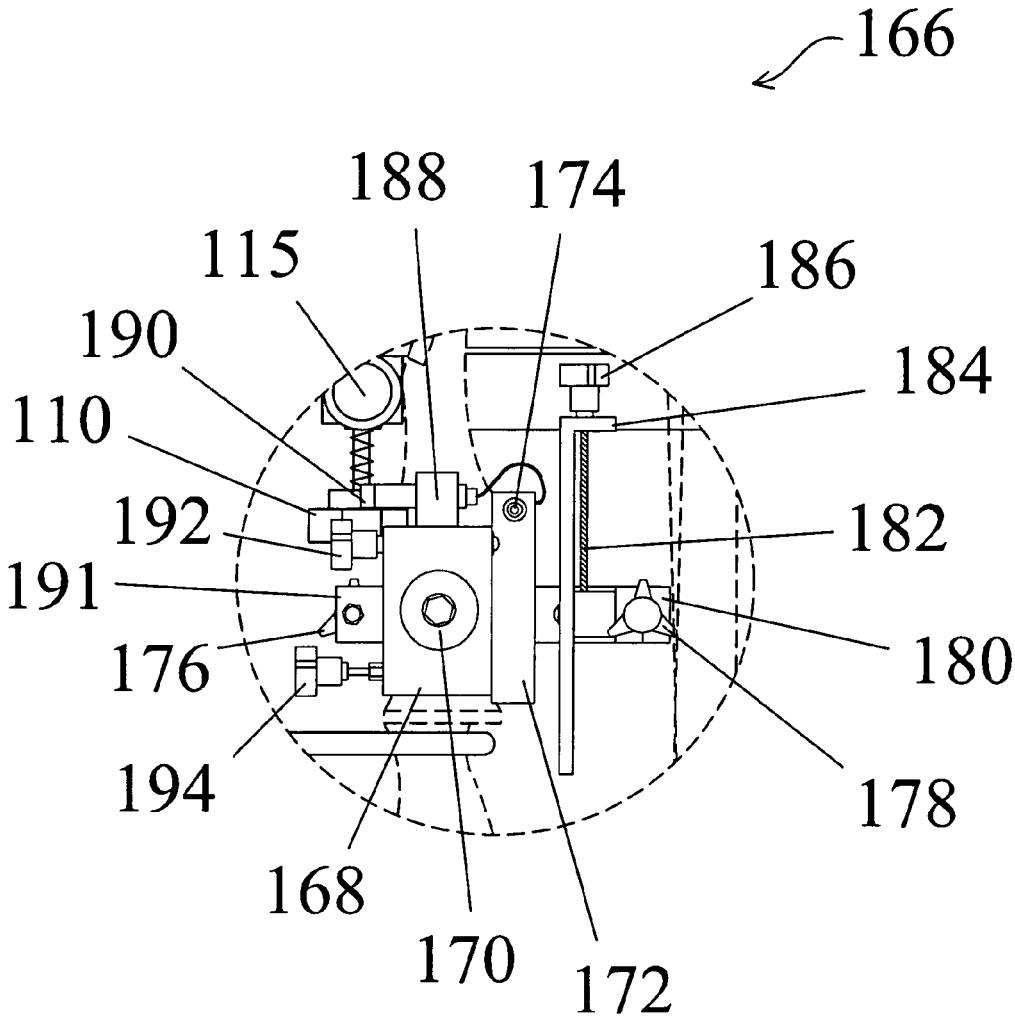
FIG. 5 is a detailed view of the section shown in FIG. 4.
Figure 22:
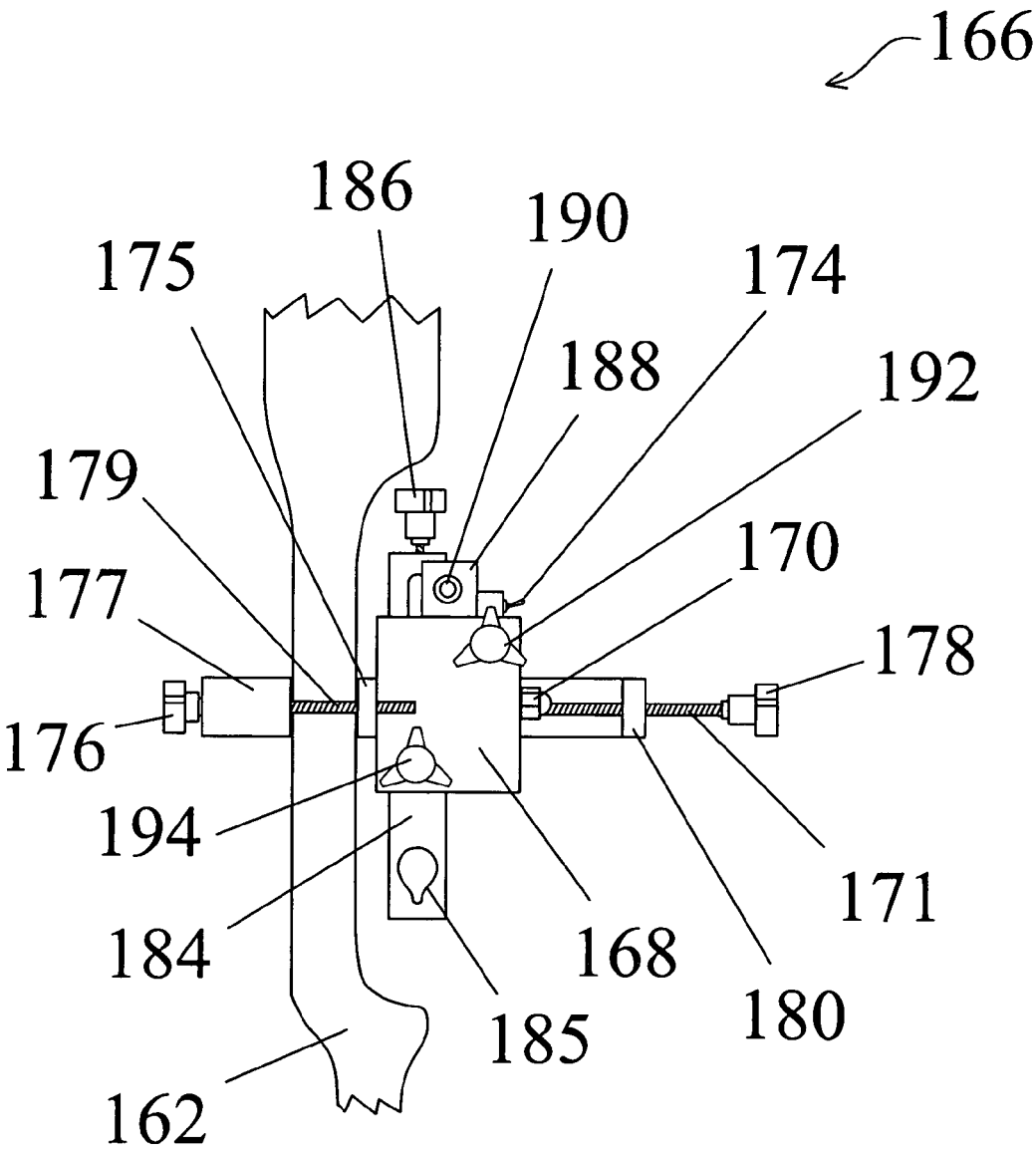
FIG. 22 is a front view of the reference laser alignment module according to an embodiment of the present invention.

Now referring to FIGS. 4, 5 and 22, a reference laser alignment module 166 is shown mounted on bow 162 and clamped in place using a clamping knob 176. Reference laser alignment module 166 has an alignment block 168 mounted around an alignment block pivot 170. A cross-hair laser battery holder 172 is attached to alignment block 168 and provides power to a cross-hair laser 190. Cross-hair laser 190 is held in place with cross-hair laser mount 188 and controlled with a switch 174. Cross-hair laser 190 is horizontally adjusted using a horizontal cross-hair laser adjust 192 and vertical cross-hair laser adjust 194. A vertical arrow support member 184 is movably attached to reference laser alignment module 166 and is adjusted using vertical arrow support adjusting screw 182 and vertical arrow support adjustment knob 186. A horizontal arrow support member 180 is adjusted using a horizontal arrow support adjuster 178. A clamping bar 177 is used to attach reference laser alignment module 166 to bow 162 in conjunction with a clamping attachment bar, bolt 179 and attachment knob 176. An arrow rest opening 185 is disposed in vertical arrow support member 184 to removably hold a reference laser arrow 204 (FIG. 9).

Figure 6:
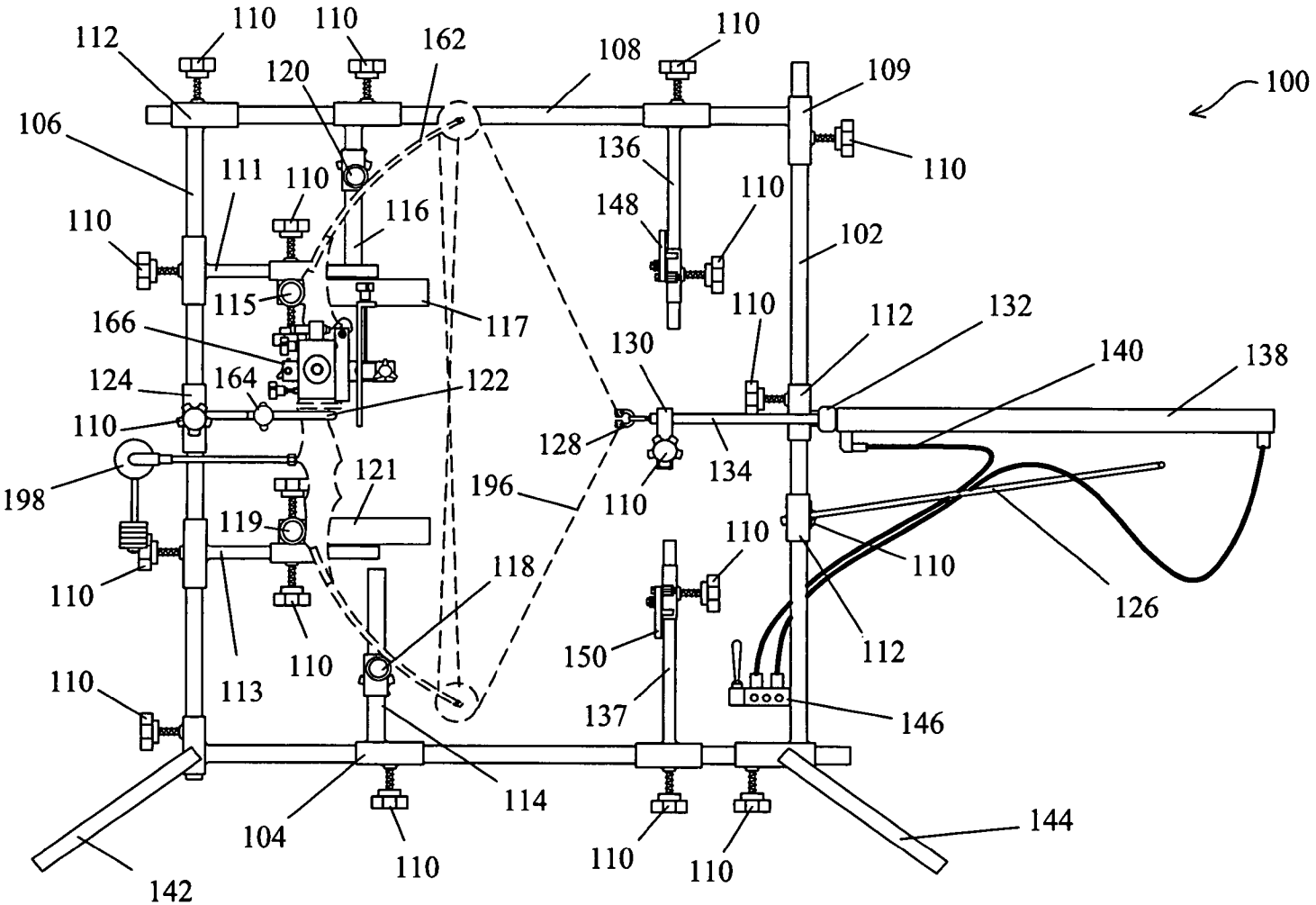
FIG. 6 is a side view of the bow alignment, analysis and repair apparatus shown in FIG. 1 with the bow drawn therein.
Figure 7:
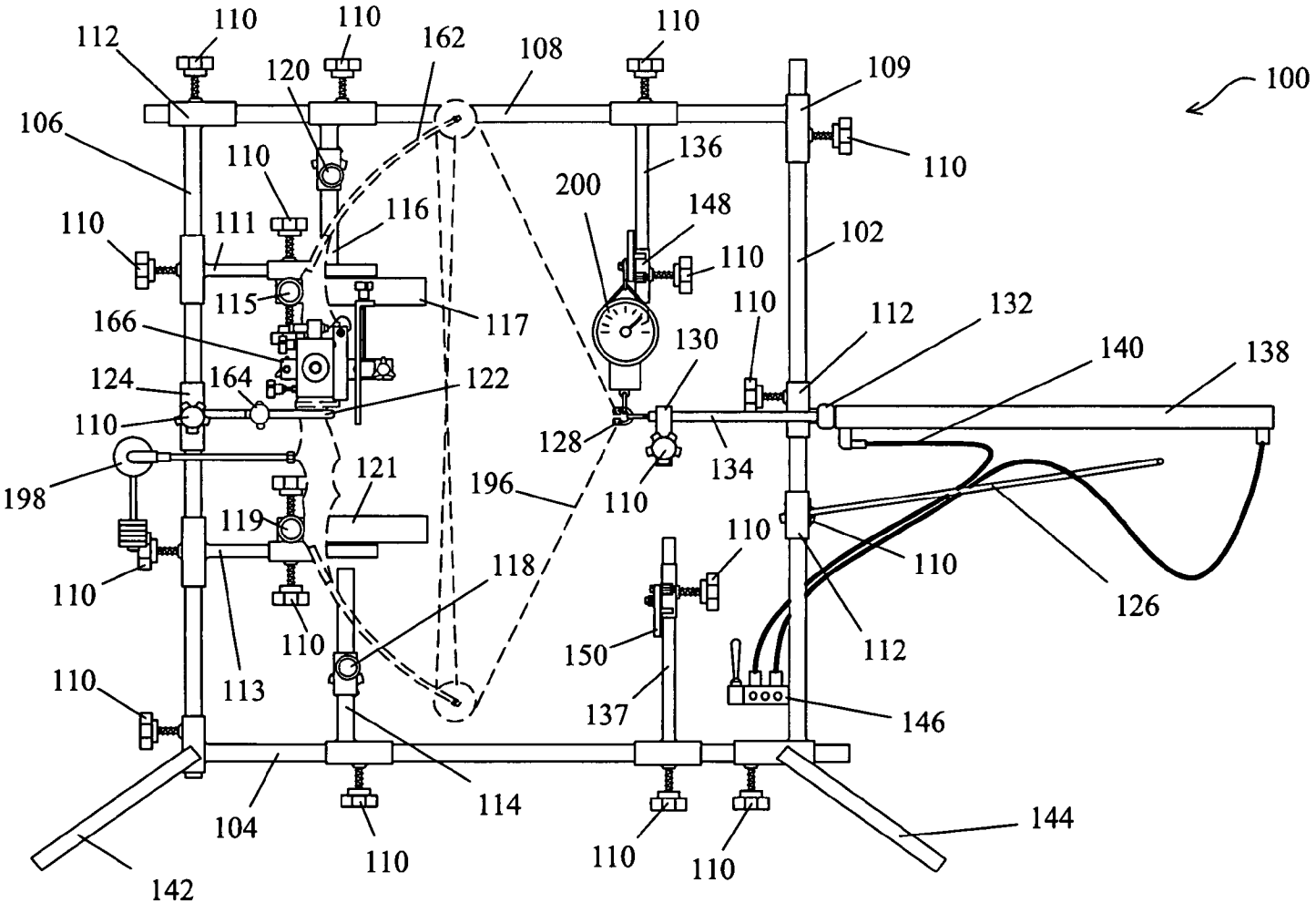
FIG. 7 is a side view of the bow alignment, analysis and repair apparatus shown in FIG. 1 with an upper limb scale mounted therein.
Figure 8:
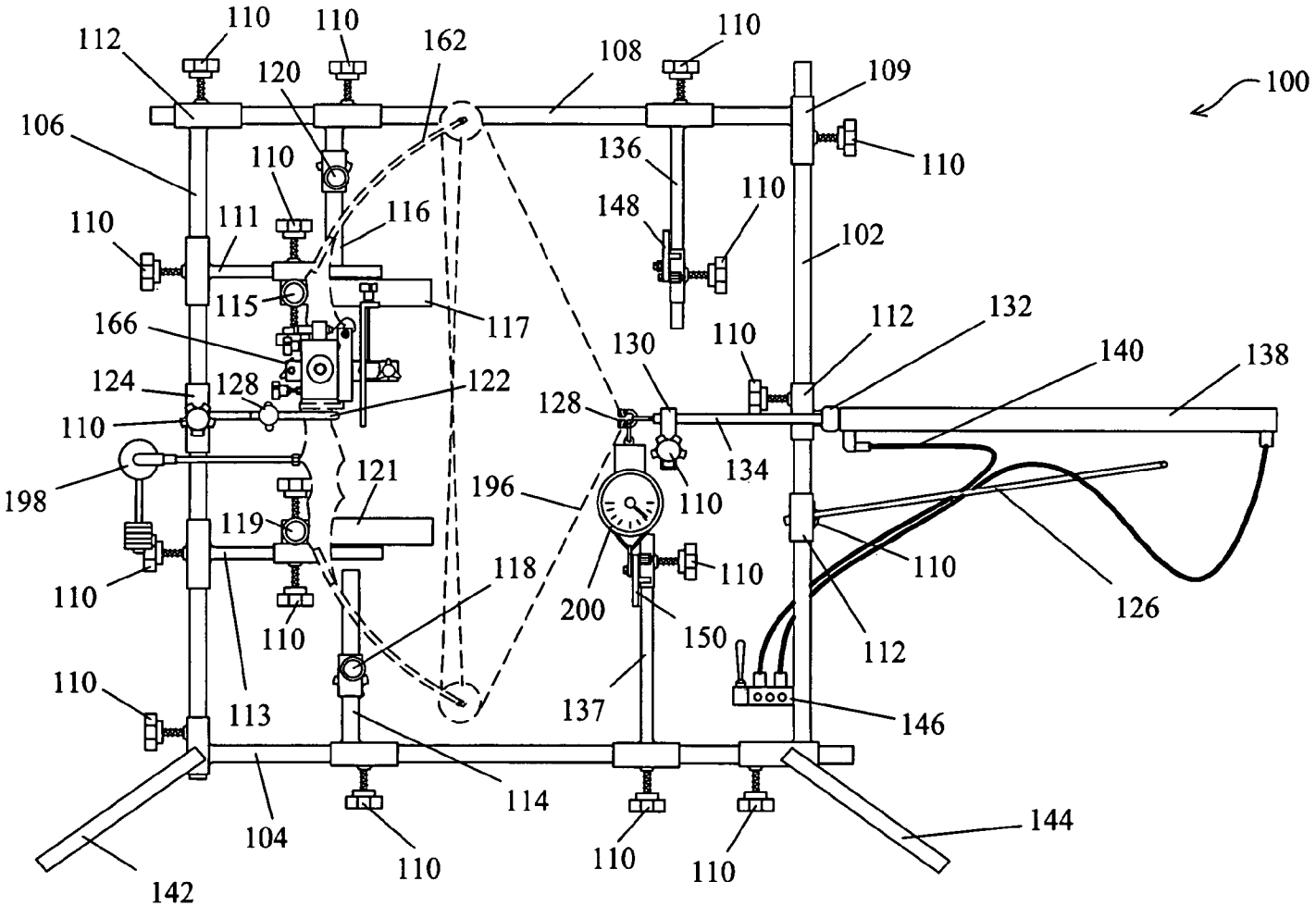
FIG. 8 is a side view of the bow alignment, analysis and repair apparatus shown in FIG. 1 with a lower limb scale mounted therein.

Referring now to FIGS. 6, 7 and 8, bow alignment, analysis and repair frame 100 is shown having a 3D balancer 198 attached to bow 162. Bow string 196 is shown drawn by air ram shaft 134 and horseshoe indexer 128. Limb scale 200 is attached to upper limb measurement fixture 148 and placed under tension to provide a reading and then to lower limb fixture 150. A level 202 is supported by 3D balancer to indicate the orientation of bow 162.

Additionally, referring to FIG. 6, dynamic bow alignment, analysis and repair frame 100 is configured as a bow press. In this use, upper limb brace support 116 and lower limb brace support 114 engage bow 162 after bow 162 is drawn using air ram 138. Once drawn, upper limb brace 120 is secured against the upper limb of bow 162 and lower limb brace 118 is secured against the lower limb of bow 162. Both upper and lower limb braces 120 and 118 respectively are covered with a protective material such as rubber, plastic or other non-marring material to protect bow 162 as is known in the art.

Figure 9:
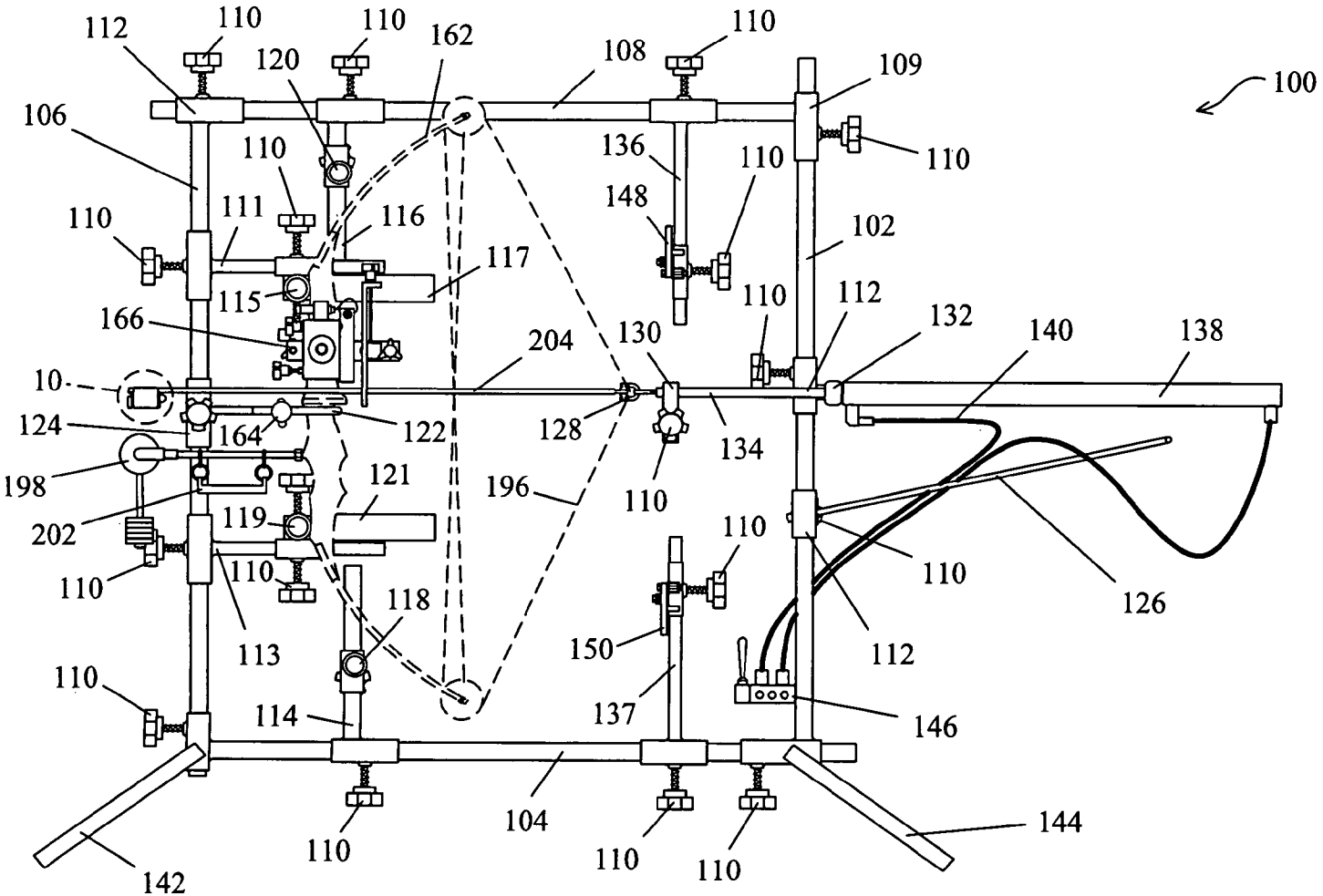
FIG. 9 is a side view of the bow alignment, analysis and repair apparatus shown in FIG. 1 with a reference arrow disposed therein.
Figure 10:
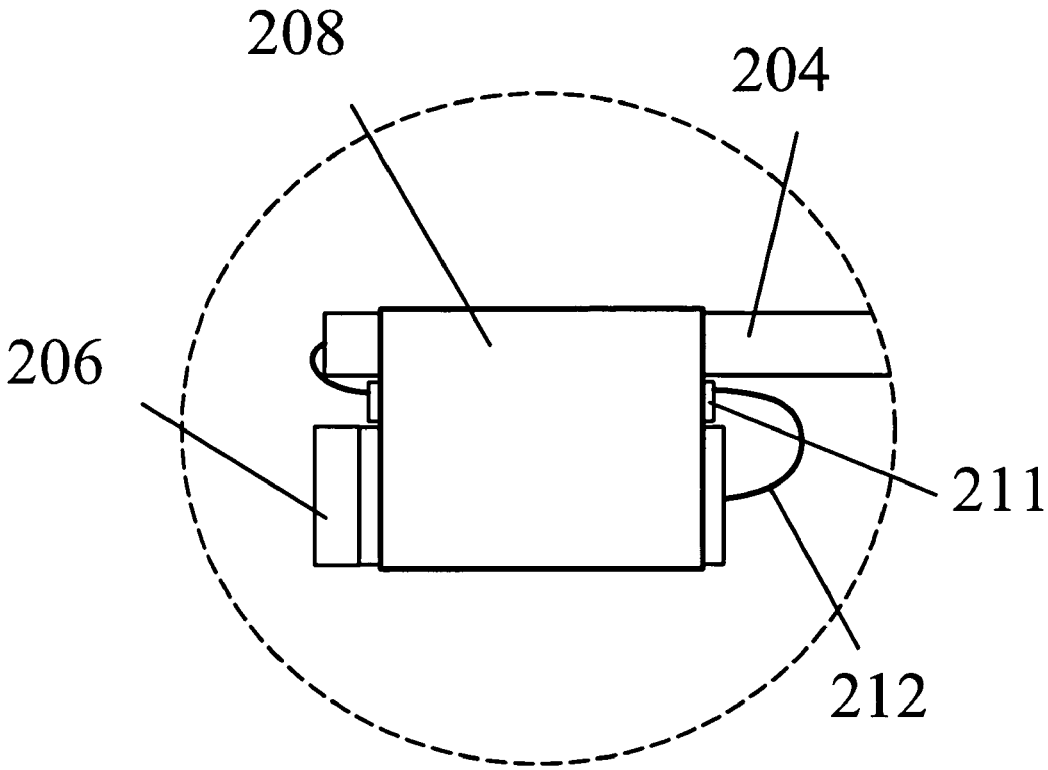
FIG. 10 is a detailed view of the section shown in FIG. 9.
Figure 11:
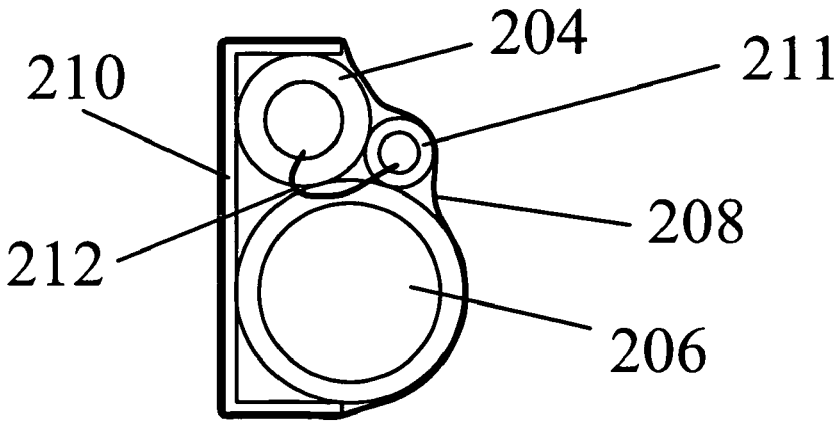
FIG. 11 is an end view of an alignment arrow according to an embodiment of the present invention.

With reference to FIGS. 9, 10 and 11, laser arrow 204 is placed in bow 162 and selectively energized by laser wire 212 connected to arrow power source (not shown). Arrow laser 204 has an arrow laser 206 mounted at its end using a spacer 211, a U-Channel mounting bracket 210 and wrapped with a heat shrinkable wrap 208. Laser wire 212 runs through the shaft therein.

Figure 12:
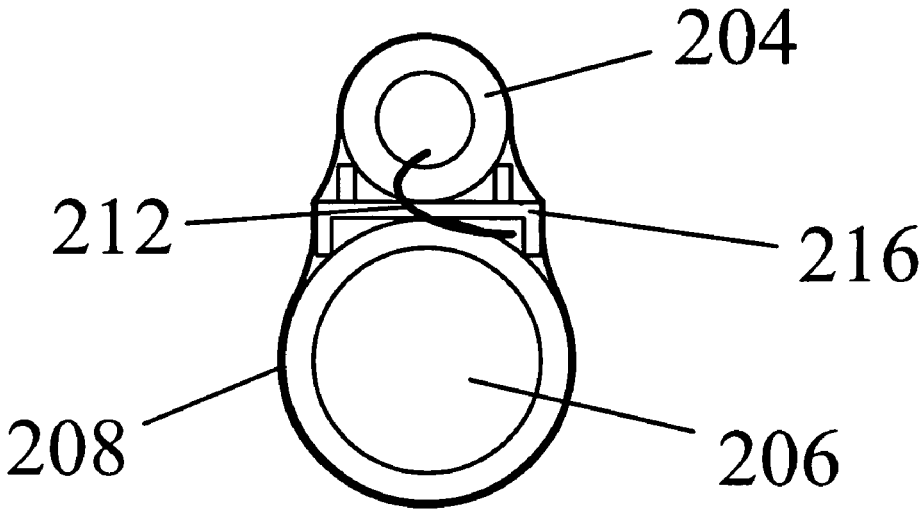
FIG. 12 is an end view of another embodiment of an alignment arrow according to the present invention.
Figure 13:
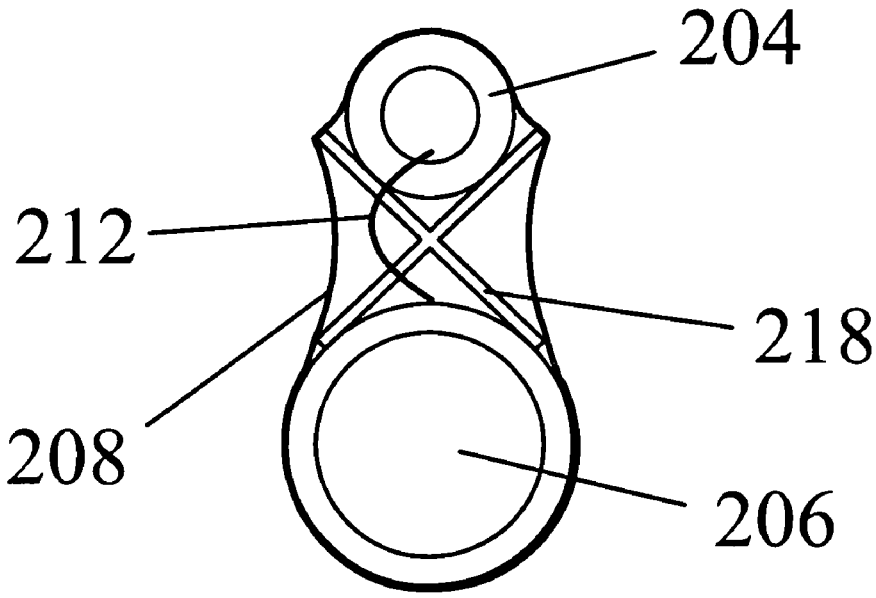
FIG. 13 is an end view of yet another embodiment of an alignment arrow according to the present invention.

FIGS. 12 and 13 are illustrations of alternative laser arrow mounting brackets. In the embodiment shown in FIG. 12, a unshaped channel 216 is used to position laser arrow 204 and arrow laser 206 and wrapped with wrap 208. An X-Channel 218 is shown in FIG. 13. Of course other embodiments are also possible as long as the laser and arrow are firmly held in axial alignment relative to each other.

Figure 14:
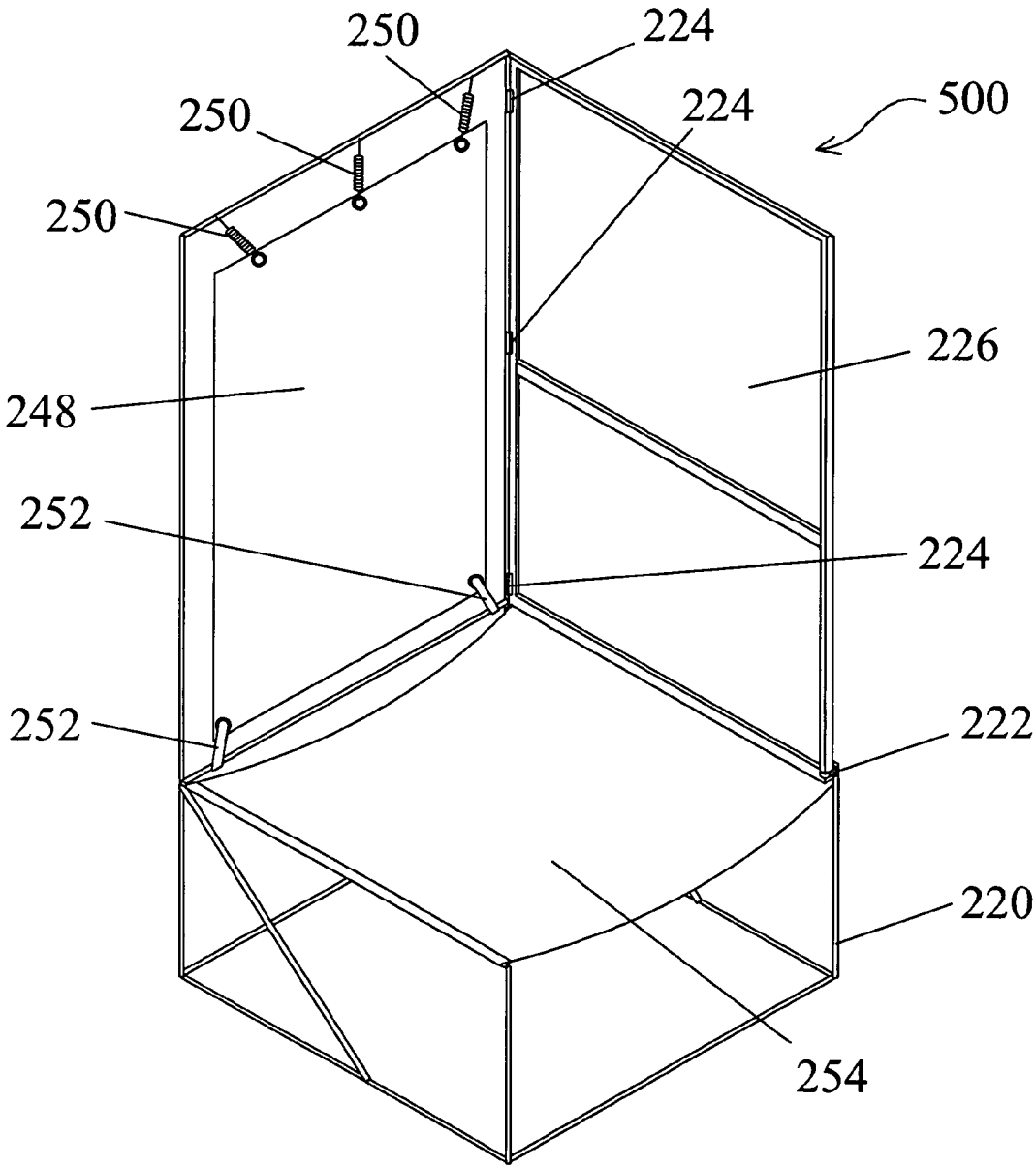
FIG. 14 is a perspective view of a screen frame according to an embodiment of the present invention.
Figure 15:
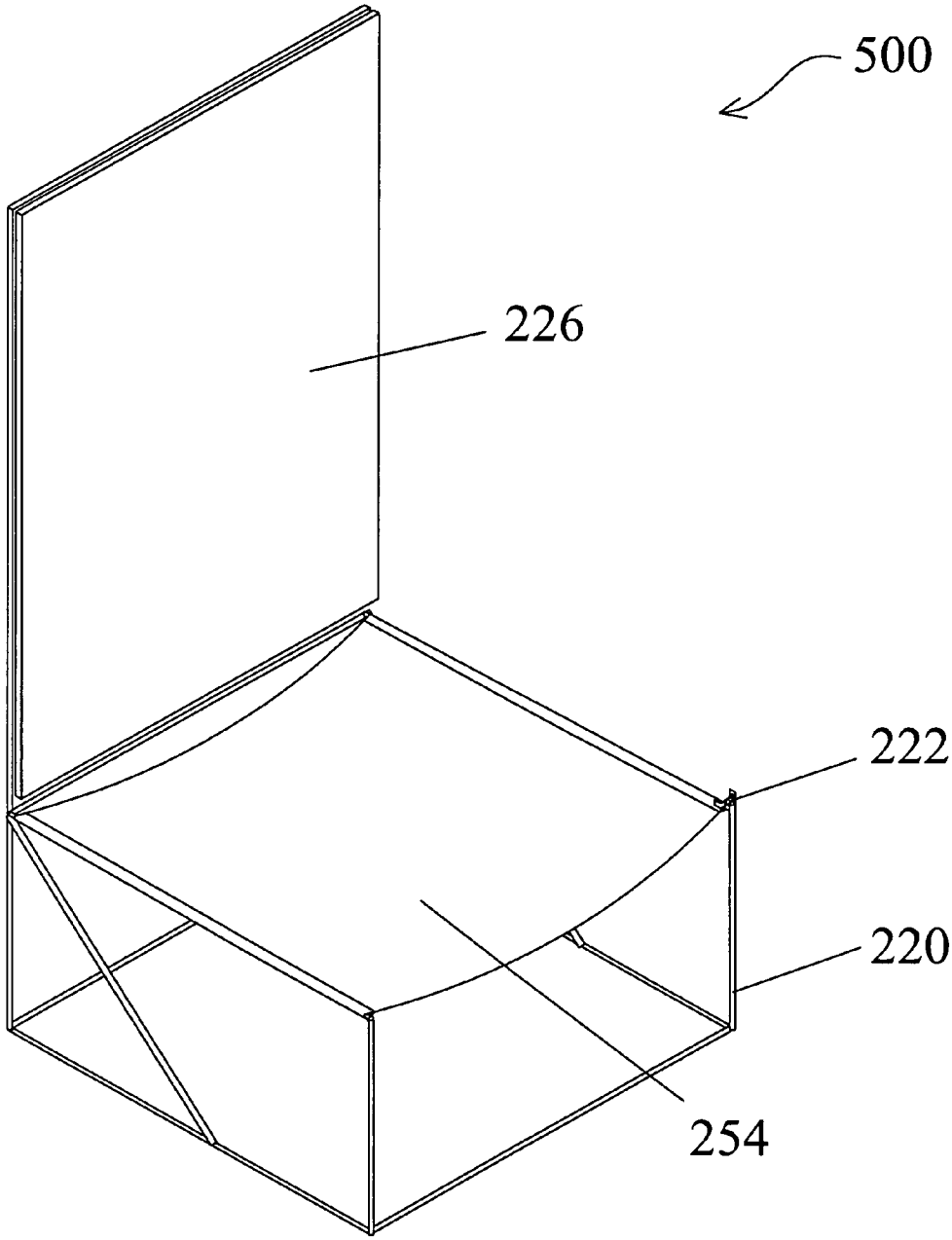
FIG. 15 is a perspective view of the screen frame shown in FIG. 14 with the screen in a closed position.

Referring now to FIGS. 14 through 17, a screen frame 500 is shown having a target frame 220 which supports a ballistic blanket 248 with spring hooks 250 and connectors 252. The purpose of ballistic blanket 248 is to non-destructively stop an arrow that has been shot from a bow. A moveable screen 226 is hingedly attached to target frame 220 with hinges 224. FIG. 14 shows movable screen 226 in an open position exposing ballistic blanket 248. FIG. 15 shows moveable screen 226 in a closed position for alignment. A screen lock 222 selectively retains screen in the open position.

Figure 16:
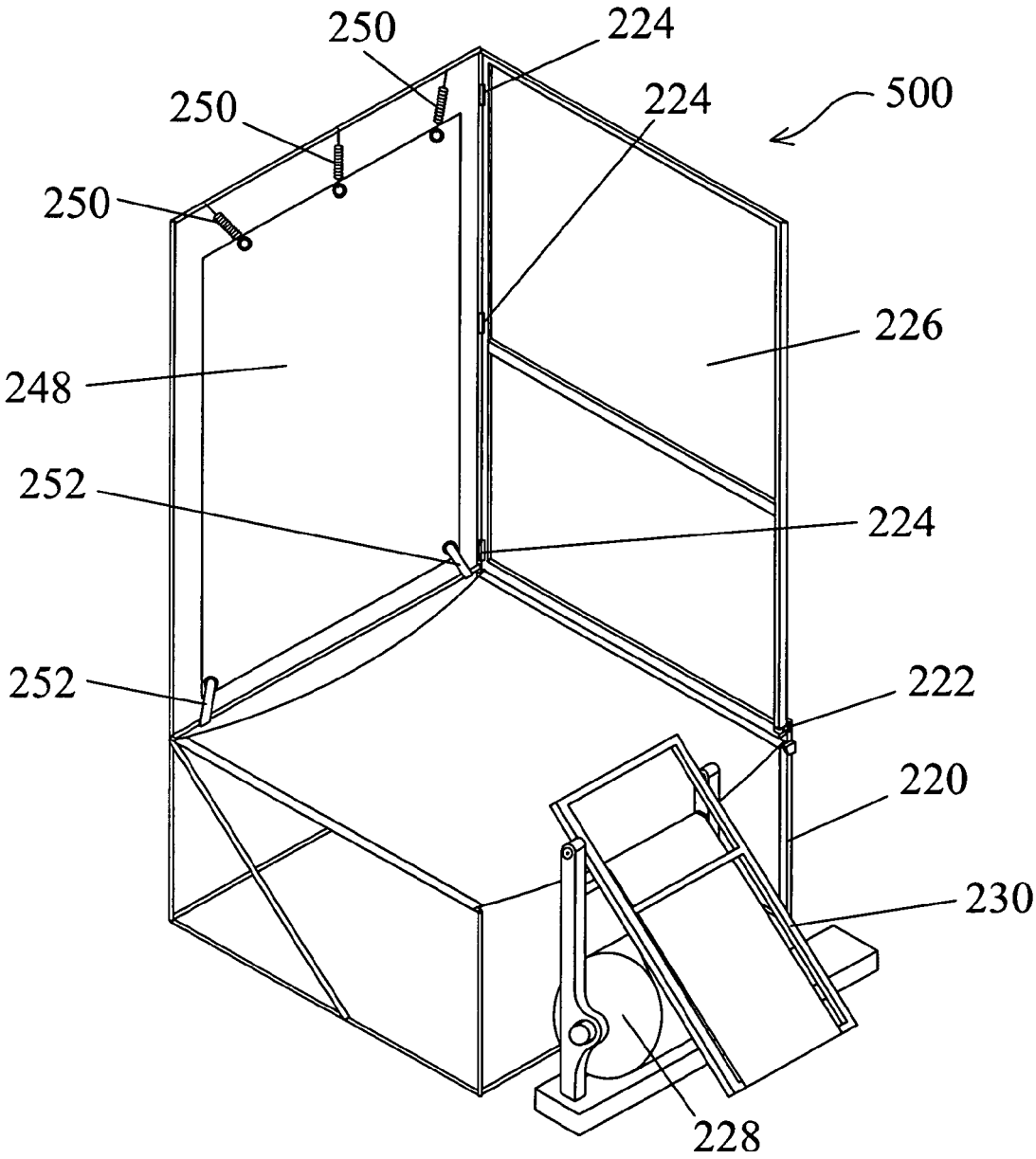
FIG. 16 is a perspective view of the screen frame shown in FIG. 14 with a folding spine test frame according to an embodiment of the present invention.
Figure 17:
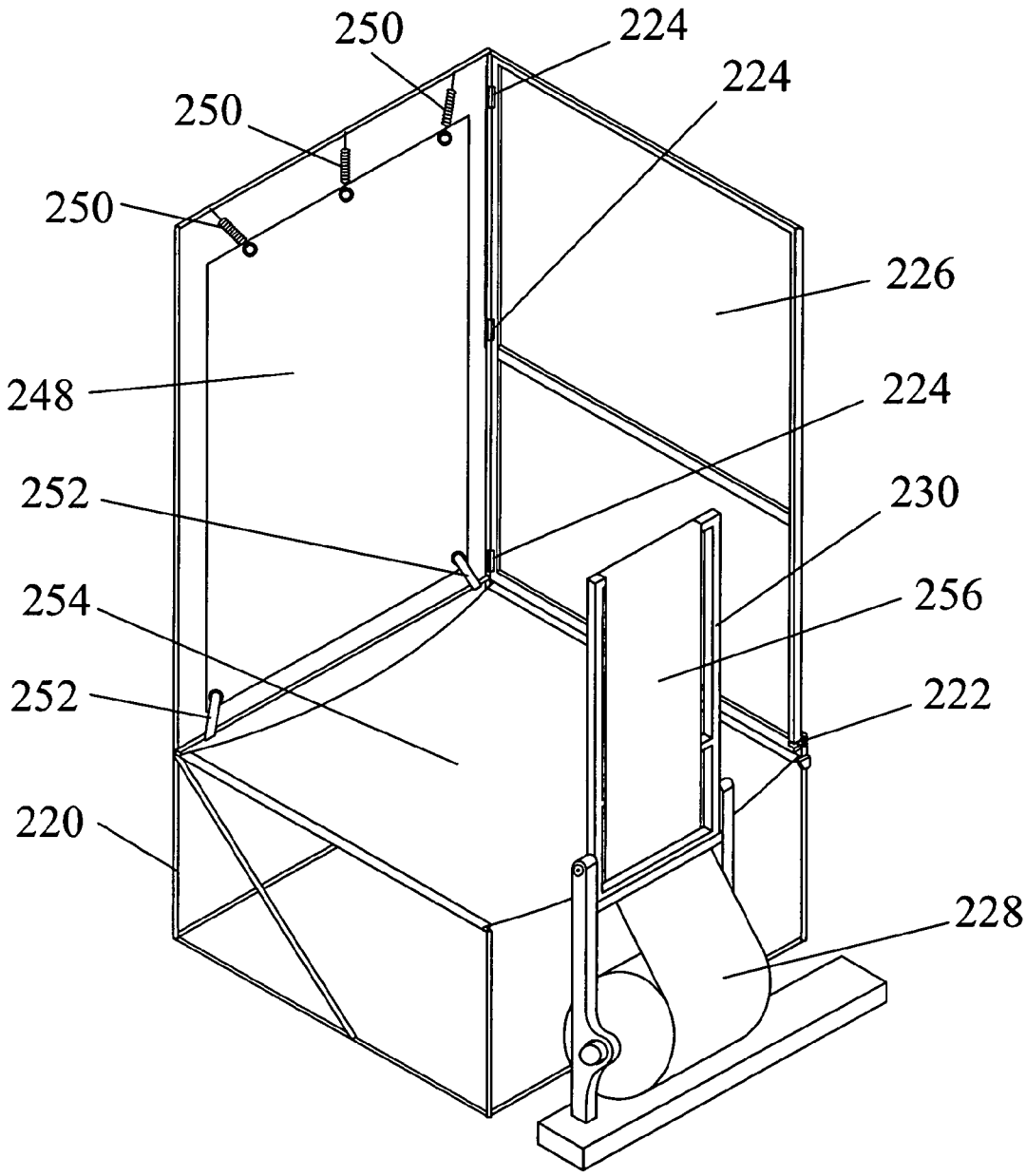
FIG. 17 is a perspective view of the screen frame shown in FIG. 14 with the folding spine test frame in an open position.

Now referring to FIGS. 16 and 17, a folding spine test frame 230 is shown folded (FIG. 16) and unfolded (FIG. 17). A roll of spine test paper 228 is fed through folding spine test frame 230 and may be advanced as needed to provide a spine test target 256. Spine test paper 228 may be tissue paper or any other suitable paper as is known in the art.

Figure 18:
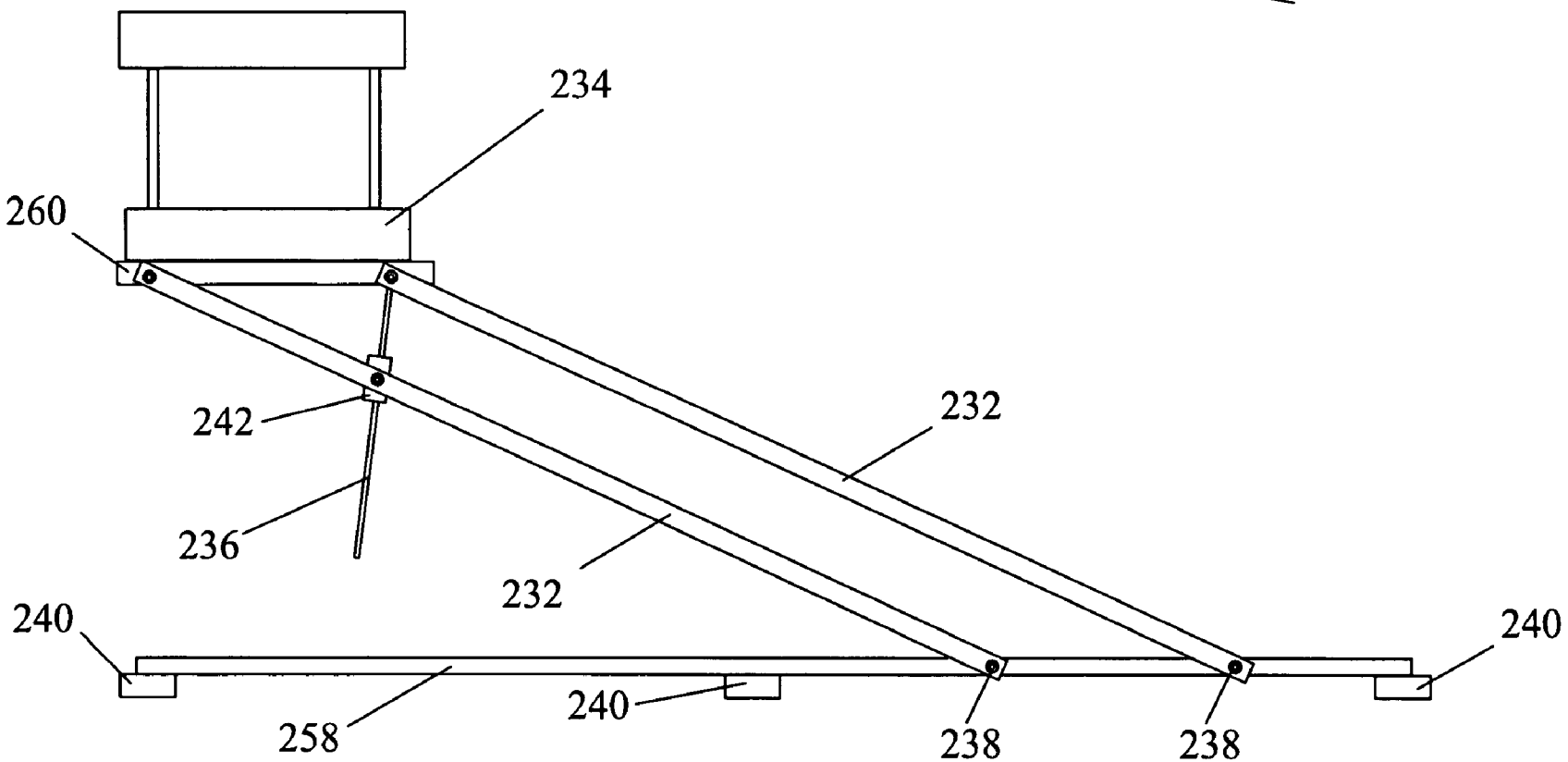
FIG. 18 is a side view of an adjustable platform according to an embodiment of the present invention.

Referring to FIG. 18, an adjustable platform 600 is shown having a plurality of supports 240 supporting an adjustable platform base 258. Four adjustable platform frames 232 are rotatably attached to adjustable platform base 258 and a pair of upper mounting supports 260 and are constrained to maintain a parallel orientation with each other in use. A rotating adjustment rod engagement collar 242 is pivotally mounted between the two lower adjustable platform frames 232. A height adjustment rod 236 is selectively positioned to provide height adjustment of a speed measurement apparatus 234 which is disposed on upper mounting supports 260.

Figure 19:
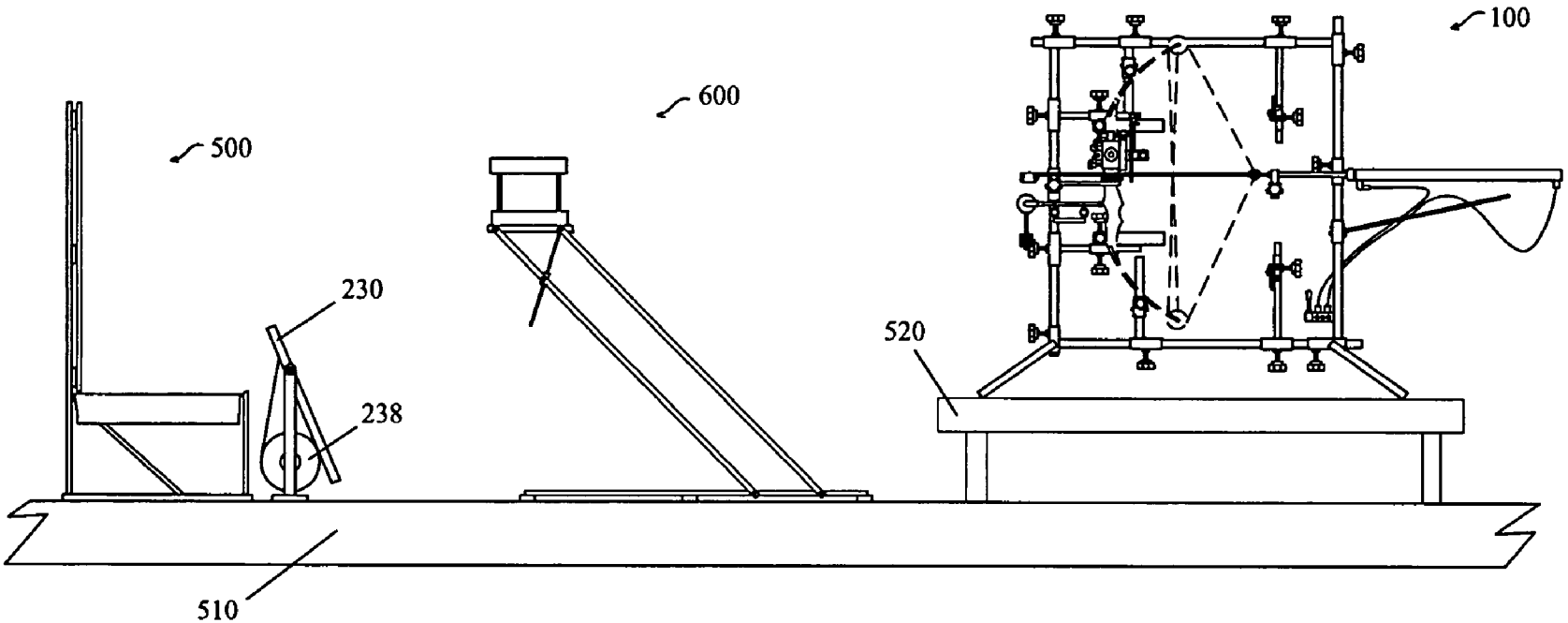
FIG. 19 is a system diagram of the components of a dynamic bow alignment, analysis and repair apparatus and system according to an embodiment of the present invention.

FIG. 19 is a system diagram that shows a typical dynamic bow alignment, analysis and repair apparatus set up for use. Dynamic bow alignment, analysis and repair frame 100 is placed on a table or workbench 520 which sits on a floor 510 and is directed towards screen frame 500 with folding spine test frame 230 placed in front of screen frame 500. Adjustable platform 600 is located between alignment frame 100 and screen frame 500.

Method of Operation:

Configuring the bow alignment, analysis and repair frame to work with a bow:

In use, bow 162 is stripped of unnecessary equipment such as quiver, sights, balancer/damper, limb covers and string silencers etc. If there is an in-string peep sight, it is not removed. Reference laser alignment module 166 is mounted to bow 162 on the bow riser just above the travel path of an arrow released from a shooting position.

In use, the horizontal frame rods 108 and 104 are adjusted to fit the selected bow. Bow 162 is secured in place by placing a bow restraint strap 164 around the bow yoke 122. Bow restraint strap is an elastic strap that firmly holds the bow 162 in place while still allowing it to be positioned further as needed. 3-D balancer 198 is attached to a stabilizer insert which is present on most modern bows and level 202 is supported by hanging horizontally on the shaft of 3-D balancer 198 as shown in FIG. 9. The weights are manipulated by adding or subtracting weights and by reorienting the position of the weights to help stabilize the bow for alignment.

Air ram shaft 134 is positioned so it is generally level with the nock indexer and then bow string 196 is engaged using horseshoe indexer 128. Next cross-hair laser 190 is energized and bow 162 is fully drawn. At this point, the user must check level 202 and adjust air ram 138 until it indicates proper orientation. When viewing a cross-hair laser pattern 246 (FIGS. 20 and 21), if the cross-hair laser projection 246 moves up at full draw, air ram 138 should be moved up; with the reverse being true. If cross-hair laser projection 246 moves significantly left or right, air ram 138 should be moved in the same direction until movement is minimized.

Measurement Procedures:

After configuring bow alignment, analysis and repair frame 100 to a selected bow 162, measurements are taken that allow a user to align the bow. The measurements are recorded. The measurements may be recorded on a sheet (not shown) prepared for this purpose or inputted in an electronic form to an aligning computer (not shown).

Steps:

Measure the distance from the top of the bow string center serving to the nock point indexer, relative to the bow riser.

Measure the distance from the center of an in-string peep sight to the nock point indexer (if peep sight is used).

Measure the rest position of the bow in the x, y and z planes. For the x position, measure the distance from riser face to point of arrow contact. For the y position, measure the distance from the center of a pressure button hole (if used) to the point of arrow contact, or from horizontal to front of bow riser. For the z position, measure the distance from bow shelf to the point of arrow contact.

The draw weight of the bow is measured by attaching limb scale 200 at the usual nock point and using the air ram 138, draw bow just beyond the "walk over point" and record the highest reading.

The draw length is measured by continuing to pull the bow to its "wall" recording the reading from the limb scale where the reading starts to rise again after passing through a "let off" region. Measure the distance from the pressure button hole (if used) or from the front of the bow riser to the nock point where the "wall" point is reached. The bow tension is released by moving the air ram and the limb scale is removed.

Measurement of the differential pull of the upper and lower limbs is taken by removing the original nock point indexer (not shown) and installing horseshoe indexer 128. The air ram is connected to horseshoe indexer 128 and the bow is drawn to the point of maximum tension and ram stop collar 130 is secured against ram mounting ring 132 to prevent the ram shaft from moving past that point. Upper and lower bow braces 114 and 116 are moved into position to secure the bow riser to immobilize it as shown in FIG. 6.

To measure the differential pull of the lower limb, limb scale 200 is secured to upper limb fixture swing arm 156 by attaching it to limb scale holder 158 and moving limb swing arm 156 to a locked over position. The limb scale reading is recorded. Limb swing arm 156 is rotated to a release position and limb scale 200 is removed. The process is repeated for the upper limb in a like manner. The lowest reading is subtracted from the highest reading allowing a "Differential Tension" to be calculated. Note that the actual reading is not important as only the differential tension is used.

Alignment Procedure:

Note: the alignment procedure is performed after configuring the frame and taking the measurements as discussed above. Also, if an in-string peep sight is used, it must be installed at this point. It can be adjusted again after completing the alignment procedure. Also, when making adjustments, use an appropriate wrench to tighten the weakest limb and loosen the stiffest limb by equal amounts to help maintain the overall draw weight. Using the bow manufacturing information or a "best guess", reset the position of horseshoe indexer 128 with the aid of a bow square (not shown) to the best guess position.

Repeat the procedure for measuring the upper and lower limb tension by drawing the bow to the same point as before by moving the ram to the ram stop collar position. Re-measure the limbs to achieve the goal of balancing the tension between the upper and lower limbs. If possible, the bow should be set to a "zero setup" where the differential is zero. Of course, some users may wish to offset the differential based on personal preference. In this case, the target differential is the goal rather than a zero setup. Small adjustments are made and measurements are taken again to direct the process towards the goal setup.

Laser reference arrow 204 is now used for the next alignment procedure. The upper bow braces 116 and 114 respectively are moved out of the way (FIG. 9) and the ram is released after releasing the ram stop collar.

Figure 20:
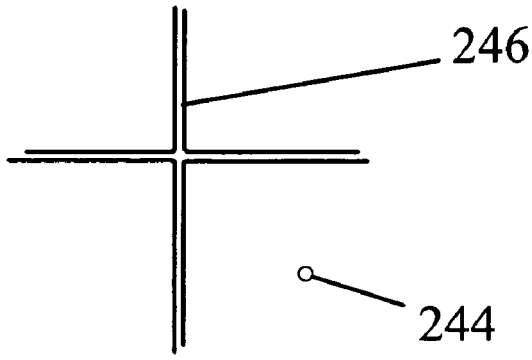
FIG. 20 is an illustration of an alignment pattern according to a method of the present invention.
Figure 21:
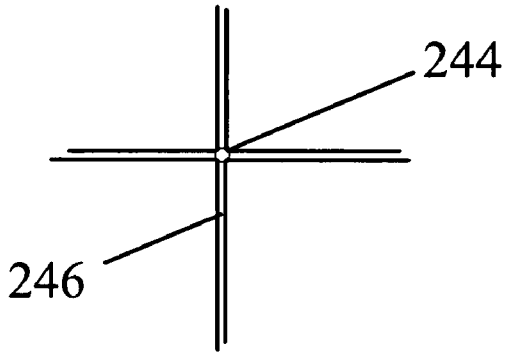
FIG. 21 is an illustration of an alignment pattern according to a method of the present invention.

Laser reference arrow 204 is inserted through arrow rest opening 185 and vertical arrow support member 184 respectively and nock laser arrow 204 to shooting string 196. Caution: Make sure that no one is downrange during any procedure using any kind of arrow including laser reference arrow 204. Energize both cross-hair laser 190 and arrow laser 206. Using air ram 138, pull bow to full draw. Adjustments are made by adjusting crosshair laser alignment mark 246 to coincide with arrow laser alignment mark 244 (FIGS. 20 and 21). The coincidence of the lasers must be checked at the relaxed undrawn position as well. Relax the bow and readjust the arrow support mechanism for coincidence. If the arrow laser alignment mark is left of the cross-hair laser alignment mark, the support mechanism is adjusted to the right using the appropriate adjustment controls, etc. Redraw the bow and check for coincidence and realign as necessary and repeat the process until coincidence is achieved for both the fully relaxed position as well as the full draw position. This is the position for the shooting rest to be installed.

Note that although theoretically coincidence should be constant and track together throughout the adjustment, dynamic anomalies can appear that are less than ideal. Diagnosing the causes of these dynamic anomalies can be performed during alignment.

In the next step, a user observes the position of the arrow shaft as it passes across the riser above the shelf. If there is a factory installed threaded pressure button port in the riser (this is the position where the shooting rest is normally anchored), the arrow shaft should pass directly in front of this hole. Note that this alignment is not required, but is useful because it indicates the position of the arrow path for a particular bow design. To complete this alignment, move both the nock indexer and the arrow support in the same direction and the same distance to achieve centering of the arrow with respect to this hole. If the pressure button threaded hole is absent or a custom hole was drilled after purchase, the elevation of the arrow shaft should be chosen to allow adequate clearance for the arrow to pass without interference with the shelf riser and the nock indexer and arrow support should be adjusted as discussed above.

Note: If it is necessary to move the nock indexer and arrow support, the alignment procedure must be repeated from the beginning because a change in anything brings about other changes and must be taken into account each time an adjustment is performed. Generally, the user should diagnose and correct other dynamic anomalies at this stage if possible. The bow is now aligned for optimum performance based on the specifics of the bow design and the manufacturing process. Changes after this point is reached will only degrade performance.

Diagnosis and Analysis of Dynamic Anomalies

If the laser beams diverge during the stroke of the draw between the fully relaxed and fully drawn position, then a dynamic anomaly is indicated. Some anomalies are repairable, while others are not.

If arrow laser alignment mark 244 moves vertically up, vertically down or a combination of both during the draw but settles in to coincidence at the extremes, then the timing of the cams or wheels should be carefully examined for excessive wear or misalignment and adjusted if possible for minimum vertical travel. Other possibilities include mismatched limbs resulting in tension variations between the limbs, flex curves of the limbs relative to each other during the stroke, or poor bow geometry due to design flaws. Additionally, unequal limb warping can lead to this behavior.

If arrow laser alignment mark 244 wanders left and/or right during the draw stroke, the cam(s) or wheel(s) should be checked for excessive or uneven wear, wobble or tilt. Limb tip warping can be a major factor in this kind of anomaly If the arrow laser alignment mark jumps or darts around during the draw stroke, look carefully for damaged cams and/or wheels, or cable that bind and release with a jerking or popping action. The limb root attachment and pivot should be carefully examined as well.

Referring again to FIG. 19, in use a bow is mounted in alignment frame 100 and the adjustment procedures are performed to adjust alignment frame 100 to match a specific bow. Next, measurements are taken as described above. Alignment is performed as discussed above and then a complete bow profile is produced by performing a spine test where the flexing movement of the arrow as it flies to the target is examined by having the arrow pass through the paper leaving a hole that is used to analyze the arrow spine properties. The spine frame 230 is foldable so that the paper can be displaced during targeting and alignment functions. Adjustable platform 600 is raised and lowered as needed. In use, a speed measurement apparatus 234 is raised into position so that an arrow shot from the bow will pass through the speed detecting circuitry to give the user an indication of the speed the arrow is traveling. In this way the bow alignment system allows a user to completely align and quantify the performance of any bow.

Safety Considerations:

Screen 226 must be made of a material that diffuses laser light to avoid dangerous reflections.

All observers should be a minimum of 5 feet from the System.

Laser safety stickers should be used to label the lasers used in the system.

No user should look directly into a laser source.

The air source for the air ram should be limited to 120 psi or below.

No one should be allowed down range of the apparatus anytime an arrow is used.

No modifications to the System are authorized.

The air ram must be secured to string in a safe manner consistent with specified equipment.

Although the instant invention has been described in relation to particular embodiments thereof, many other variations and modifications and other uses will become apparent to those skilled in the art.

What is claimed is:

1. A method of aligning a bow; the method comprising the steps of:

(a) obtaining a dynamic bow alignment, analysis and repair apparatus;

(b) obtaining a suitable viewing surface disposed at an effective distance from said dynamic bow alignment, analysis and repair apparatus;

(c) mounting a bow to said dynamic bow alignment, analysis and repair apparatus;

(d) mounting a reference laser alignment module to said bow;

(e) projecting a reference laser and an arrow laser on said viewing surface;

(f) obtaining a result by performing at least one alignment operation on said bow while observing a relative motion of said projected reference laser with respect to said arrow laser;

(g) adjusting said bow in response to said result;

(h) repeating step (f) to cause an effect thereof; and (i) repeating steps (g) through (h) until bow is optimized.

2. The method of aligning a bow according to claim 1 wherein step (f) includes a limb force measurement.

3. The method of aligning a bow according to claim 1 wherein step (d) further comprises the step of adjusting said laser alignment module wherein a reference arrow is adjusted.

* * * * *